US008253478B2

(12) United States Patent
Jung et al.

(10) Patent No.: US 8,253,478 B2
(45) Date of Patent: Aug. 28, 2012

(54) INTERNAL VOLTAGE GENERATING CIRCUIT FOR SEMICONDUCTOR DEVICE

(75) Inventors: Jin-Kyoung Jung, Suwon (KR); Jung-Bae Lee, Yongin (KR); Kyu-Hyoun Kim, Suwon (KR)

(73) Assignee: Samsung Electronics Co., Ltd. (KR)

( * ) Notice: Subject to any disclaimer, the term of this patent is extended or adjusted under 35 U.S.C. 154(b) by 0 days.

(21) Appl. No.: 12/325,846

(22) Filed: Dec. 1, 2008

(65) Prior Publication Data

US 2009/0085650 A1 Apr. 2, 2009

Related U.S. Application Data

(62) Division of application No. 10/799,783, filed on Mar. 12, 2004, now abandoned.

(30) Foreign Application Priority Data

Apr. 28, 2003 (KR) ..... 10-2003-0026850

(51) Int. Cl.
*G05F 1/10* (2006.01)

(52) U.S. Cl. ..... 327/540

(58) Field of Classification Search ..... None
See application file for complete search history.

(56) References Cited

U.S. PATENT DOCUMENTS

| | | | | |
|---|---|---|---|---|
| 4,683,382 | A | 7/1987 | Sakurai et al. | |
| 5,349,559 | A | 9/1994 | Park et al. | |
| 5,721,485 | A | 2/1998 | Hsu et al. | |
| 5,910,924 | A | 6/1999 | Tanaka et al. | |
| 6,058,061 | A * | 5/2000 | Ooishi | 365/222 |
| 6,084,386 | A * | 7/2000 | Takahashi et al. | 323/273 |
| 6,111,457 | A | 8/2000 | Lim et al. | |
| 6,184,744 | B1 | 2/2001 | Morishita | |
| 6,297,624 | B1 | 10/2001 | Mitsui et al. | |
| 6,373,754 | B1 | 4/2002 | Bae et al. | |
| 6,633,196 | B2 * | 10/2003 | Sher | 327/525 |
| 6,774,712 | B2 * | 8/2004 | Rhee et al. | 327/540 |
| 7,002,854 | B2 * | 2/2006 | Takahashi et al. | 365/189.09 |
| 7,282,989 | B2 * | 10/2007 | Byeon | 327/541 |
| 7,417,494 | B2 * | 8/2008 | Choi et al. | 327/541 |
| 2001/0000655 | A1 * | 5/2001 | Morishita | 327/541 |
| 2002/0053943 | A1 | 5/2002 | Yamasaki et al. | |
| 2002/0136065 | A1 | 9/2002 | Messager | |
| 2004/0004513 | A1 * | 1/2004 | Rhee et al. | 327/540 |

FOREIGN PATENT DOCUMENTS

| | | |
|---|---|---|
| JP | 2000-11649 | 1/2000 |
| KR | 10-0240874 | 10/1999 |
| KR | 2002-0073938 | 9/2002 |

* cited by examiner

*Primary Examiner* — Lincoln Donovan
*Assistant Examiner* — Khareem E Almo
(74) *Attorney, Agent, or Firm* — Onello & Mello, LLP

(57) ABSTRACT

An internal voltage generating circuit is provided. The internal voltage generating circuit of a semiconductor device includes a control signal generating circuit for generating a control signal according to a number of data bits, a comparator for comparing a reference voltage to an internal voltage to generate a driving signal when the control signal is inactivated, a driving signal control circuit for inactivating the driving signal when the control signal is activated, and an internal voltage driving circuit for receiving an external power voltage and generating the internal voltage in response to the driving signal. Therefore, an internal voltage can be turned to a reference voltage level or to an external power voltage level according to the number of data input and/or output bits of a semiconductor device, and even when the number of data input and/or output bits is increased, a data access speed can be improved.

7 Claims, 8 Drawing Sheets

INTERNAL VOLTAGE GENERATING CIRCUIT FOR SEMICONDUCTOR DEVICE

This U.S. nonprovisional patent application is a divisional application of U.S. patent application Ser. No. 10/799,783, filed Mar. 12, 2004, which claims priority under 35 U.S.C. §119 of Korean patent application 10-2003-26850 filed on Apr. 28, 2003, the contents of which are hereby incorporated herein in their entirety by reference.

BACKGROUND OF THE INVENTION

1. Field of the Invention

The present invention relates to a semiconductor device, more particularly to an internal voltage generating circuit for a semiconductor device which receives or outputs data, such as a semiconductor memory device.

2. Description of Related Art

An internal voltage generating circuit of a typical semiconductor memory device includes an internal voltage generating circuit for a memory cell array and an internal voltage generating circuit for a peripheral circuit of the memory cell array such as a data IO (input/output) circuit and a data IO control circuit. An internal voltage generating circuit of double data rate (DDR) and RAMBUS semiconductor memory devices further include an internal voltage generating circuit for a delay locked loop (DLL).

The internal voltage generating circuit of the semiconductor memory device receives an external power voltage and compares a reference voltage for a memory cell array, a reference voltage for a peripheral circuit, and a reference voltage for a delay locked loop to an internal voltage for a memory cell array, an internal voltage for a peripheral circuit, and an internal voltage for a delay locked loop, respectively, to generate an internal voltage of a reference voltage level for a memory cell array, an internal voltage of a reference voltage level for a peripheral circuit, and an internal voltage of a reference voltage level for a delay locked loop.

FIG. 1 is a view illustrating a conventional internal voltage generating circuit. The internal voltage generating circuit includes a comparator 10 and a driver D. The driver D includes a PMOS transistor P.

The comparator 10 receives an external power voltage EVC as a power voltage and compares a reference voltage VREF to an internal voltage IVC to raise a level of a node A when the internal voltage IVC is higher than the reference voltage VREF or to lower a level of a node A when the internal voltage IVC is lower than the reference voltage VREF. The PMOS transistor P is improved in driving ability when a level of a node A is raised and is degraded in driving ability when a level of a node A is lowered, thereby maintaining the internal voltage IVC to the reference voltage VREF.

The internal voltage generating circuit for a memory cell array, the internal voltage generating circuit for a peripheral circuit and the internal voltage generating circuit for a delay locked loop have the same configuration as that of FIG. 1. The internal voltage is set to be lower in level than the external power voltage EVC.

As described above, the internal voltage generating circuit of the conventional semiconductor memory device generates a constant internal voltage independently from a data input/output bit number. However, as a data input/output bit number increases, a level drop of the internal voltage for the memory cell array does not occur, but level drops of the internal voltages for the peripheral circuit and/or the delay locked loop occur. Hence, there is a problem in that data access speed goes down.

In detail, the internal voltage for the memory cell array is applied to PMOS bit line sense amplifies to be used to amplify data of bit line pairs, but the number of the PMOS bit line sense amplifiers is not increased by an increase of a data input/output bit number during operation. Therefore, a voltage drop of the internal voltage for the memory cell array does not occur even though the data input/output bit number is increased. However, in the case of the internal voltage for the peripheral circuit and/or the delay locked loop, the number of circuit components is increased as a data input/output bit number is increased, whereby a voltage drop occurs leading to a slow data access speed.

Consequently, the internal voltage generating circuits for the peripheral circuit and/or the delay locked loop of the conventional semiconductor memory device are configured to generate a constant internal voltage regardless of a data input/output bit number, and thus when a data input/output bit number is increased a data access speed is degraded.

The above described problem of the conventional internal voltage generating circuit is explained focusing on the semiconductor memory device, but such a problem can occur in all semiconductor devices which receive or output data.

SUMMARY OF THE INVENTION

It is an object of the present invention to provide an internal voltage generating circuit of a semiconductor device which raises a level of an internal voltage to thereby improve a data access speed when a data input/output bit number is increased.

In order to achieve the above object, the present invention provides an internal voltage generating circuit of a semiconductor device, comprising: a control signal generating circuit for generating a control signal according to a number of data bits; a comparing circuit for comparing a reference voltage to an internal voltage to generate a driving signal when the control signal is inactivated; a driving signal control circuit for inactivating the driving signal when the control signal is activated; and an internal voltage driving circuit for receiving an external power voltage and generating the internal voltage in response to the driving signal.

The present invention further provides an internal voltage generating circuit of a semiconductor device, comprising: a control signal generating circuit for generating a control signal according to a number of data bits; a comparing circuit for comparing a reference voltage to an internal voltage to generate a comparing signal; a switching circuit for transmitting the comparing signal as a driving signal when the control signal is inactivated; a driving signal control circuit for inactivating the driving signal when the control signal is activated; and an internal voltage driving circuit for receiving an external power voltage and generating the internal voltage in response to the driving signal.

The driving signal control circuit includes an NMOS transistor which has a drain connected to a driving signal generating terminal for generating the driving signal, a gate to which the control signal is applied, and a source connected to a ground voltage.

The internal voltage driving circuit includes a PMOS transistor which has a source to which the external power voltage is applied, a gate to which the driving signal is applied, and a drain connected to an internal voltage generating terminal for generating the internal voltage, wherein the PMOS transistor turns the internal voltage to a reference voltage level in response to the driving signal and turns the internal voltage to an external power voltage level when the driving signal is inactivated.

The present invention further provides an internal voltage generating circuit of a semiconductor device, comprising: a control signal generating circuit for generating a control signal according to a number of data bits; a first internal voltage generating circuit for receiving a reference voltage and an internal voltage to turn the internal voltage to a reference voltage level; a second internal voltage generating circuit for receiving an external power voltage to turn the internal voltage to an external power voltage level; a first switching circuit for supplying the external power voltage to the first internal voltage generating circuit when the control signal is inactivated; and a second switching circuit for supplying the external power voltage to the second internal voltage generating circuit when the control signal is activated.

The present invention further provides an internal voltage generating circuit of a semiconductor device, comprising: a first internal voltage generating circuit for comparing a first reference voltage to a first internal voltage and turning the first internal voltage to a first reference voltage level; a second internal voltage generating circuit for comparing a second reference voltage to a second internal voltage to turn the second internal voltage to a second reference voltage level or to turn the second internal voltage to an external power voltage level in response to a control signal; and a control signal generating circuit for generating the control signal according to a number of data bits.

The control signal generating circuit activates or inactivates the control signal by using a fuse option or a bonding option or by receiving a mode setting signal together with a mode setting command.

BRIEF DESCRIPTION OF THE DRAWINGS

The foregoing and other objects, features and advantages of the invention will be apparent from the more particular description of a preferred embodiment of the invention, as illustrated in the accompanying drawings in which like reference characters refer to the same parts throughout the different views. The drawings are not necessarily to scale, emphasis instead being placed upon illustrating the principles of the invention.

DETAILED DESCRIPTION OF PREFERRED EMBODIMENTS

Figure 1:
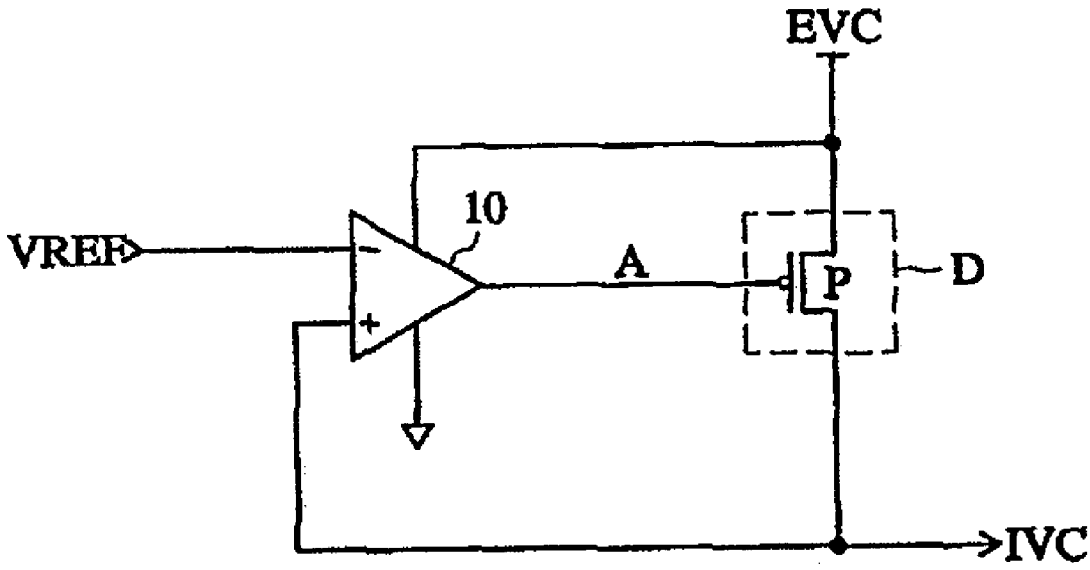
FIG. 1 (PRIOR ART)
FIG. 1 is a schematic diagram illustrating a conventional internal voltage generating circuit.
Figure 2:
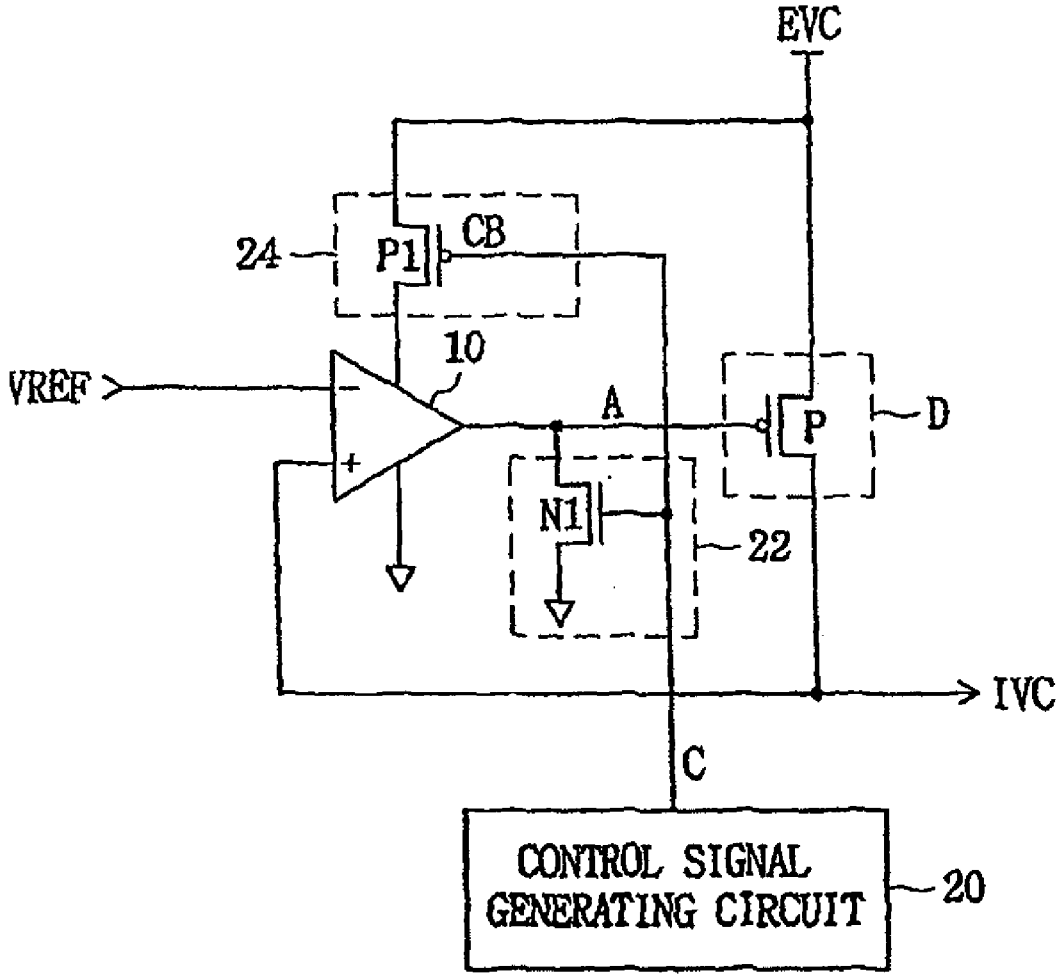
FIG. 2 is a schematic diagram illustrating an internal voltage generating circuit according to a first embodiment of the present invention.

FIG. 2 is a schematic diagram illustrating an internal voltage generating circuit according to a first embodiment of the present invention. The internal voltage generating circuit includes a control signal generating circuit 20, a driving control circuit 22, and a comparator control circuit 24 in addition to a configuration of the internal voltage generating circuit of FIG. 1. The driving control circuit 22 includes an NMOS transistor N1, and the comparator control circuit 24 includes a PMOS transistor P1.

The control signal generating circuit 20 generates a control signal C having a "high" level when the number of data bits which are simultaneously input or output is more than a predetermined bit number (e.g., 18-bits) and generates a control signal C having a "low" level when the number of data bits is less than a predetermined bit number (e.g., 18-bits). When a control signal C having a "low" level is generated, the PMOS transistor P1 is turned on, and the NMOS transistor N1 is turned off. The comparator 10 and the PMOS transistor P perform the same operation as described in FIG. 1. That is, an internal voltage IVC level becomes a reference voltage VREF level. On the other hand, when a control signal C having a "high" level is generated, the PMOS transistor P1 is turned off, and the NMOS transistor N1 is turned on. An external power voltage EVC is cut off, so that operation of the comparator 10 is disabled, and a node A becomes a "low" level. As a result, the PMOS transistor P is turned on, so that an internal voltage IVC becomes an external power voltage EVC level.

Figure 3:
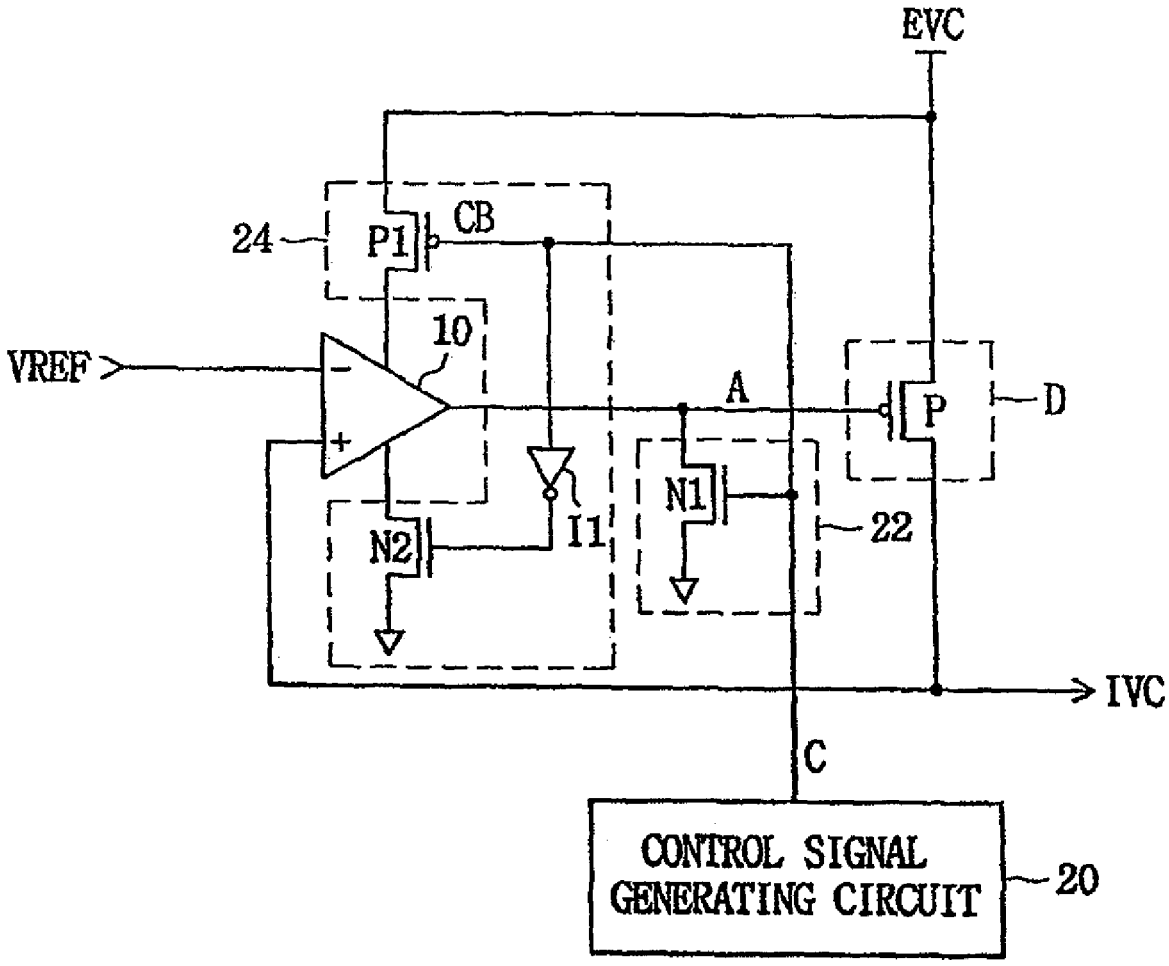
FIG. 3 is a schematic diagram illustrating an internal voltage generating circuit according to a second embodiment of the present invention.

FIG. 3 is a view illustrating an internal voltage generating circuit according to a second embodiment of the present invention. The internal voltage generating circuit additionally includes an NMOS transistor N2 and an inverter I1 which are added to the comparator control circuit 24 of the internal voltage generating circuit of FIG. 2.

The internal voltage generating circuit of FIG. 3 performs the same operation as that of FIG. 2 except that when a control signal C having a "high" level is generated the PMOS transistor P1 and the NMOS transistor N2 are turned off, and so an external power voltage and a ground voltage to be applied to the comparator 10 are all cut off to disable operation of the comparator 10.

As described above, the internal voltage generating circuits of FIGS. 2 and 3 change a state of the control signal C according to the number of data input/output bits to turn the internal voltage IVC to the reference voltage VREF level or to an external voltage EVC level. When the control signal C is set to a "low" level, the internal voltage generating circuits of FIGS. 2 and 3 enable operation of the comparator 10 and disable operation of the driving control circuit 22 to turn the internal voltage IVC to the reference voltage VREF level, and when the control signal C is set to a "high" level, the internal voltage generating circuits of FIGS. 2 and 3 disable operation of the comparator 10 and enable operation of the driving control circuit 22 to turn the internal voltage IVC to the external voltage EVC level.

Figure 4:
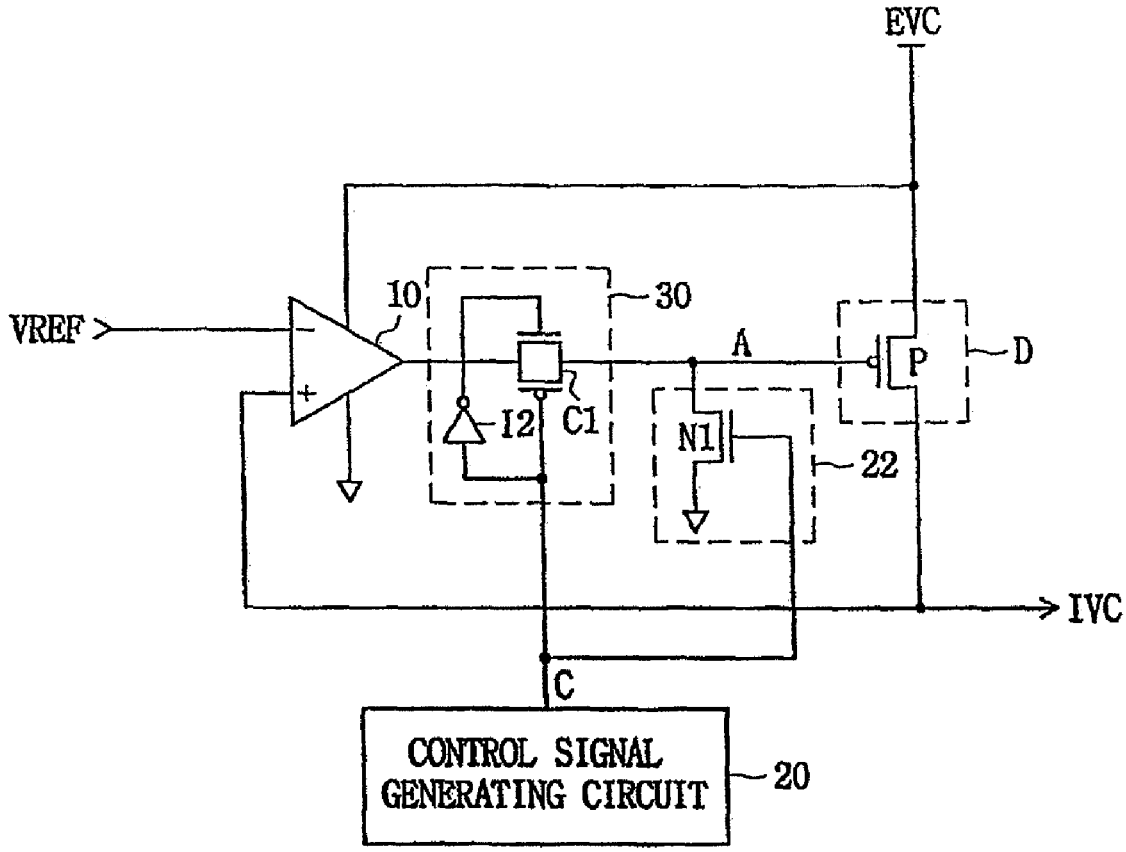
FIG. 4 is a schematic diagram illustrating an internal voltage generating circuit according to a third embodiment of the present invention.

FIG. 4 is a view illustrating an internal voltage generating circuit according to a third embodiment of the present invention. The internal voltage generating circuit includes a control signal generating circuit 20, a driving control circuit 22 and a switching circuit 30 in addition to a configuration of that of FIG. 1. The driving control circuit 22 includes an NMOS transistor N1, and the switching circuit 30 includes a CMOS transmission gate C1 and an inverter I2.

Like that of FIG. 2, the control signal generating circuit 20 generates a control signal C having a "low" level or a "high" level according to the number of data input/output bits. When the control signal C having a "low" level is generated, the NMOS transistor N1 is turned off, and the inverter I2 inverts the control signal C having a "low" level to a signal having a "high" level. Hence, the CMOS transmission gate C1 is turned on. As a result, the internal voltage generating circuit performs the same operation as that of FIG. 1. On the other hand, when the control signal C has a "high" level, the NMOS transistor N1 is turned on, and the inverter I2 inverts the control signal C having a "high" level to a signal having a "low" level. Hence, the CMOS transmission gate C1 is turned off. As a result, an output signal of the comparator 10 is not transferred, and a node A becomes a ground voltage level. The PMOS transistor P turns the internal voltage IVC to the external power voltage EVC in response to a ground voltage level at node A.

Figure 5:
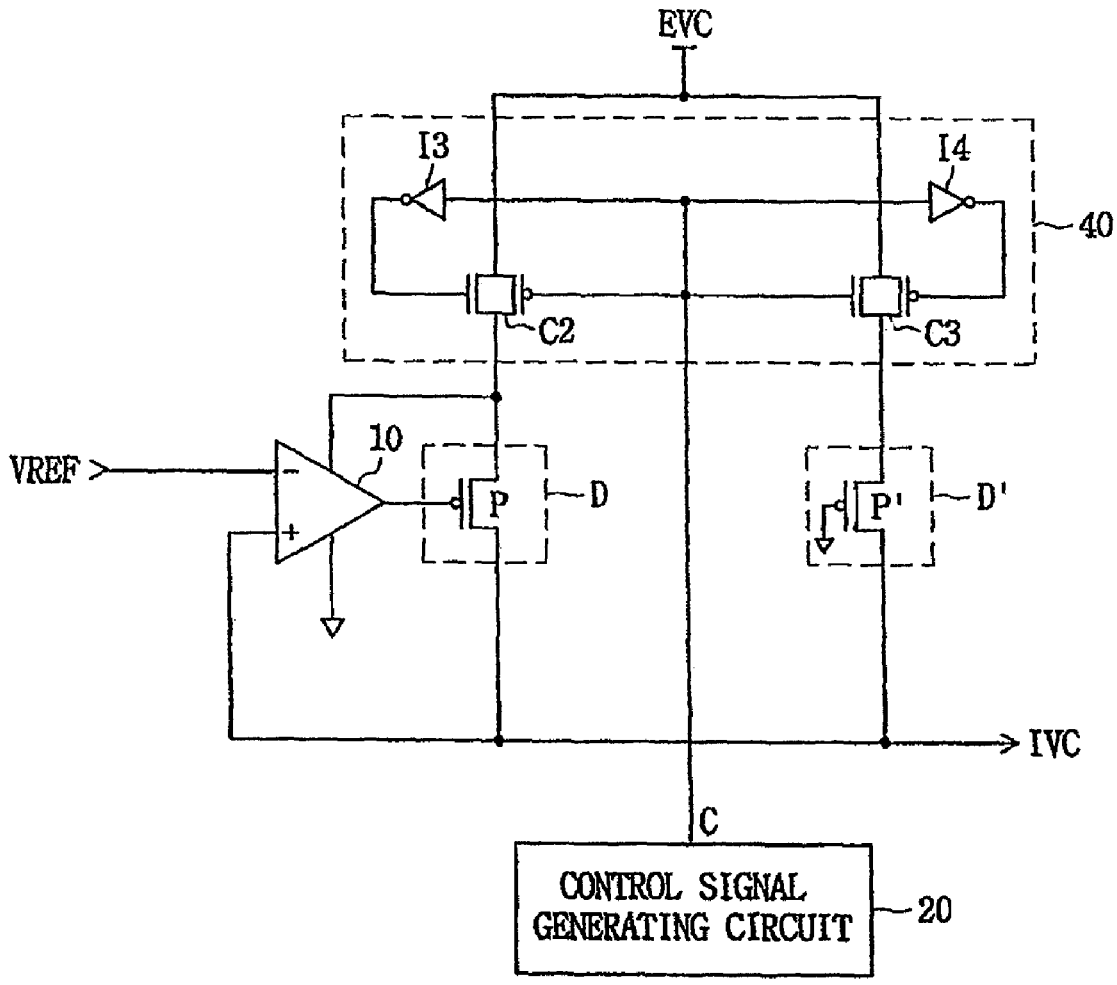
FIG. 5 is a schematic diagram illustrating an internal voltage generating circuit according to a fourth embodiment of the present invention.

FIG. 5 is a view illustrating an internal voltage generating circuit according to a fourth embodiment of the present invention. The internal voltage generating circuit of FIG. 5 includes a control signal generating circuit 20, a switching circuit 40, and a driver D' in addition to a configuration of that of FIG. 1. The driver D' includes a PMOS transistor P', and the switching circuit 40 includes inverters I3 and I4 and CMOS transmission gates C2 and C3.

Like that of FIG. 2, the control signal generating circuit 20 generates a control signal C having a "low" level or a "high" level according to the number of data input/output bits. When the control signal C having a "low" level is generated, the inverters I3 and I4 invert the control signal C having a "low" level to a signal having a "high" level. Hence, the CMOS transmission gate C2 is turned on, and the CMOS transmission gate C3 is turned off. An external power voltage EVC is applied to the comparator 10 and the PMOS transistor P, and an external power voltage EVC to be applied to the PMOS transistor P' is cut off. Hence, the PMOS transistor P' does not operate, and the comparator 10 and the PMOS transistor P perform the same operation as FIG. 1 to turn the internal voltage IVC to the reference voltage VREF level. On the other hand, when the control signal C having a "high" level is generated, the inverters I3 and I4 invert the control signal C having a "high" level to a signal having a "low" level. Hence, the CMOS transmission gate C2 is turned off, and the CMOS transmission gate C3 is turned on. An external power voltage EVC is not supplied to the comparator 10 and the PMOS transistor P but is supplied to the PMOS transistor P'. As a result, the comparator 10 and the PMOS transistor P do not operate, but the PMOS transistor P' operates to turn the internal voltage IVC to an external power voltage EVC level.

The internal voltage generating circuits of FIGS. 4 and 5, like those of FIGS. 2 and 3, change a state of a control signal C output from the control signal generating circuit 20 to turn an internal voltage IVC to a reference voltage VREF level or an external power voltage EVC.

Figure 6:
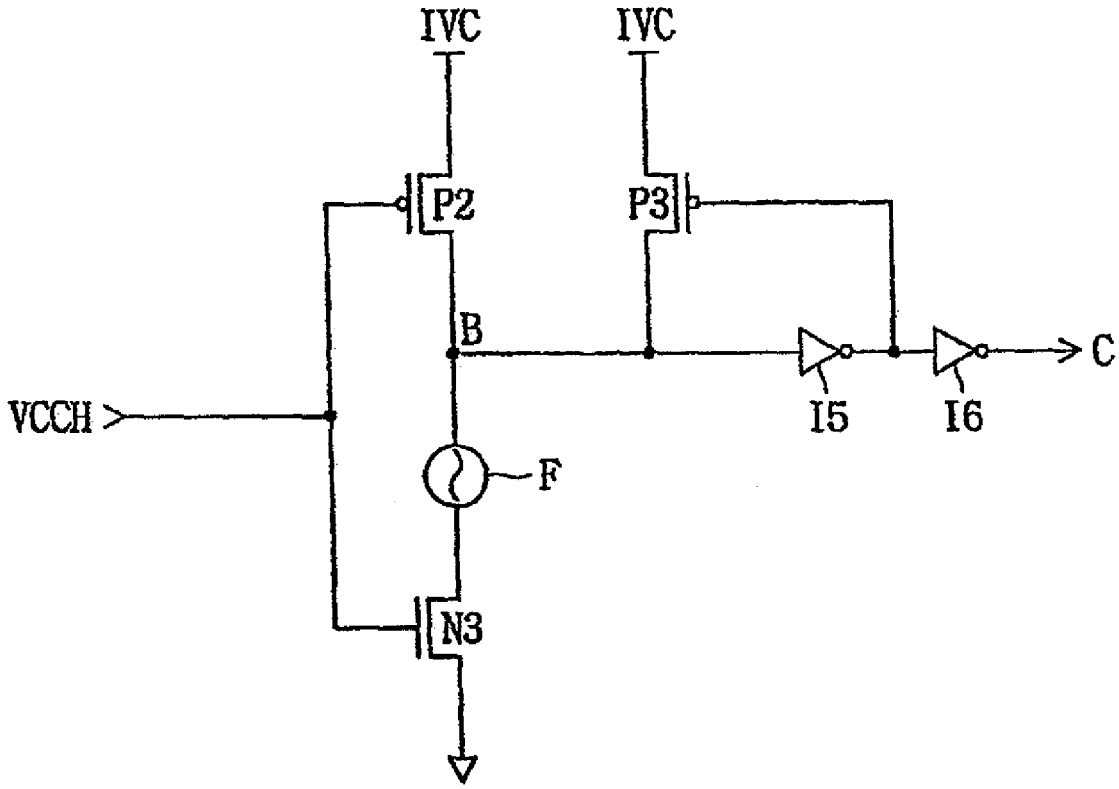
FIG. 6 is a schematic diagram illustrating a first embodiment of a control signal generating circuit according to the present invention.

FIG. 6 is a view illustrating a first embodiment of the control signal generating circuit according to the present invention. The control signal generating circuit of FIG. 6 includes PMOS transistors P2 and P3, a fuse F, an NMOS transistor N3, and inverters I5 and I6.

In FIG. 6, when a power voltage is applied a power up signal VCCH maintains a "low" level, and when a power voltage is turned to more than a predetermined level the power up signal VCCH is transited to a "high" level. An internal voltage IVC is applied to sources of the PMOS transistors P2 and P3.

When the power up signal VCCH having a "low" level in the state that the fuse is not cut, the PMOS transistor P2 is turned on, and the NMOS transistor N3 is turned off, so that a signal having a "high" level is transmitted to a node B. The inverter I5 inverts a signal having a "high" level of a node B to generate a signal having a "low" level, and the inverter I6 inverts an output signal of the inverter I5 to generate a signal having a "high" level. The PMOS transistor P3 is turned on in response to an output signal of the inverter I4 to latch a signal having a "high" level of a node B. When the power up signal VCCH is transited to a "high" level, the PMOS transistor P2 is turned off, and the NMOS transistor N3 is turned on. Hence, a level of a node B is transited from a "high" level to a "low" level. The inverter I5 inverts a signal having a "low" level to generate a signal having a "high" level, and the inverter I6 inverts a signal having a "high" level to generate a control signal C having a "low" level. The PMOS transistor P3 is turned off in response to an output signal of the inverter I5. That is, when the fuse F is not cut, a control signal which maintains a "low" level after becoming a "high" level is generated.

On the other hand, when the power up signal VCCH having a "low" level is applied in the state that the fuse F is cut, the same operation as in the state that the fuse F is not cut is performed to generate a control signal C having a "high" level. When the power up signal VCCH is transited to a "high" level, the PMOS transistor P2 is turned off, and the NMOS transistor N3 is turned on. However, since the fuse F is cut, a level of a node B is maintained to a "high" level. Hence, a signal latched by the PMOS transistor P3 and the inverter I5 is continually generated, and thus a control signal C having a "high" level is generated. That is, when the fuse F is cut, a control signal C having a "high" level is generated.

As described above, the control signal generating circuit of FIG. 6 fixes a control signal C to a "high" level or a "low" level by using a fuse option.

Figure 7:
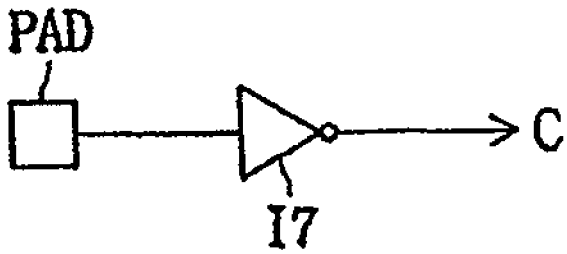
FIG. 7 is a schematic diagram illustrating a second embodiment of a control signal generating circuit according to the present invention.

FIG. 7 is a view illustrating a second embodiment of the control signal generating circuit according to the present invention. The control signal generating circuit includes a control signal pad PAD and an inverter I7.

When the control signal pad PAD is connected to a power voltage pad (not shown) and a power voltage is applied, a power voltage is applied to the pad PAD, and the inverter I7 inverts a signal having a "high" level to generate a control signal C having a "low" level.

On the other hand, when the control signal pad PAD is connected to a ground voltage pad (not shown) and a ground voltage is applied, a ground voltage is applied to the pad PAD, and the inverter I7 inverts a signal having a "low" level to generate a control signal C having a "high" level.

Here, the pad may be connected to a power voltage pad or a ground voltage pad by a wire or a metal line.

The control signal generating circuit of FIG. 7 fixes a control signal C to a "high" level or a "low" level by using a wire bonding or a metal option.

Figure 8:
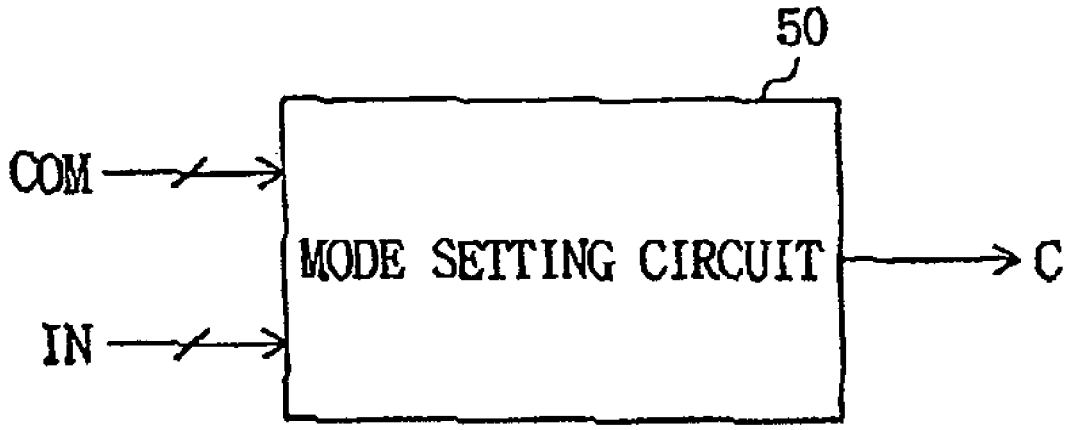
FIG. 8 is a schematic diagram illustrating a third embodiment of a control signal generating circuit according to the present invention.

FIG. 8 is a view illustrating a third embodiment of a control signal generating circuit according to the present invention. The control signal generating circuit includes a mode setting circuit 50.

When a command COM (e.g., an inverted chip selection signal CSB of a "low" level", an inverted low address strobe signal RASB of a "low" level", an inverted column address strobe signal CASB of a "low" level", and an inverted write enable signal WEB of a "low" level") to set a mode of semiconductor memory devices is applied, the mode setting circuit 50 receives and combines a mode setting code IN from an external portion to generate a control signal C. That is, the mode setting circuit 50 generates a control signal C having a "high" level or a "low" level according to a mode setting code.

The control signal generating circuit of FIG. 8 sets a control signal C to a "high" level or a "low" level by using a mode setting circuit.

The control signal generating circuits of FIGS. 6 and 7 fix a state of the control signal C to a "high" level or a "low" level according to the number of data input/output bits in a wafer state, but the control signal generating circuit of FIG. 8 can set the control signal to a "high" level or a "low" level according to the number of data input/output bits in a package state as well as a wafer state.

When the internal voltage generating circuit of the present invention is used as an internal voltage generating circuit for a peripheral circuit and/or a delay locked loop of a semiconductor memory device, and the control signal is set to an active state, even as the number of data input/output bits is increased, a level drop of an internal voltage for the peripheral circuit and/or the delay locked loop does not occur, thereby improving data access speed. Also, the internal voltage generating circuit of the present invention can conditionally be used as an internal voltage generating circuit for a memory cell array of a semiconductor memory device.

The internal voltage generating circuit of the present invention can be applied to other semiconductor devices which receive or output data as well as a semiconductor memory device.

The internal voltage generating circuit of the present invention can turn an internal voltage to a reference voltage level or an external power voltage according to the number of data input/output bits.

Therefore, when a data input/output bit number is high, a level of an internal voltage does not drop, thereby improving data access speed.

While the invention has been particularly shown and described with reference to preferred embodiments thereof, it will be understood by those skilled in the art that the foregoing and other changes in form and details may be made therein without departing from the spirit and scope of the invention.

What is claimed is:

1. An internal voltage generating circuit of a semiconductor device, comprising:

a control signal generating circuit for generating a control signal;

a first CMOS transmission gate for receiving an external power voltage and outputting the external power voltage when the control signal is inactivated, wherein the control signal is applied to gates of the first CMOS transmission gate;

a second CMOS transmission gate for receiving the external power voltage and outputting the external power voltage when the control signal is activated, wherein the control signal is applied to gates of the second CMOS transmission gate;

a first internal voltage generating circuit for receiving the external power voltage through the first CMOS transmission gate, and receiving a reference voltage and an internal voltage to turn the internal voltage to a reference voltage level; and a second internal voltage generating circuit for receiving the external power voltage through the second CMOS transmission gate to turn the internal voltage to an external power voltage level, wherein when the control signal is inactivated, the first CMOS transmission gate supplies the external power voltage to the second internal voltage generating circuit, and the second CMOS transmission gate does not supply the external power voltage to the second internal voltage generating circuit, wherein when the control signal is activated, the second CMOS transmission gate supplies the external power voltage to the second internal voltage generating circuit and the second CMOS transmission gate does not supply the external power voltage to the first internal voltage generating circuit, and wherein the first internal voltage generating circuit comprises a driving transistor with a power input connected to the external power voltage through the first CMOS transmission gate.

2. The circuit of claim 1, wherein the control signal is always activated when the number of data bits is more than a predetermined number and the control signal is always inactivated when the number of data bits is less than the predetermined number.

3. The circuit of claim 1, wherein the control signal is at a low level when inactivated, and wherein the control signal is at a high level when activated.

4. The circuit of claim 1, wherein the first internal voltage generating circuit comprises:

a comparator having a negative input terminal, a positive input terminal and an output terminal; and a PMOS transistor, wherein the negative input terminal of the comparator is configured to receive the reference voltage, the positive input terminal of the comparator is configured to receive the internal voltage, and the output terminal of the comparator is connected to a gate of the PMOS transistor, and wherein a source of the PMOS transistor is connected to an output of the first CMOS transmission gate, and a drain of the PMOS transistor is connected to the internal voltage.

5. The circuit of claim 1, wherein the control signal generating circuit activates or inactivates the control signal using a fuse option.

6. The circuit of claim 1, wherein the control signal generating circuit activates or inactivates the control signal using a bonding option.

7. The circuit of claim 1, wherein the control signal generating circuit activates or inactivates the control signal by receiving a mode setting signal together with a mode setting command.

* * * * *